US010884358B2

(12) United States Patent
Park et al.

(10) Patent No.: US 10,884,358 B2
(45) Date of Patent: Jan. 5, 2021

(54) DEVELOPING DEVICE HAVING AN AIR DISCHARGE PATH

(71) Applicant: HEWLETT-PACKARD DEVELOPMENT COMPANY, L.P., Spring, TX (US)

(72) Inventors: Jong Hyun Park, Suwon (KR); Oh Dug Kwon, Suwon (KR); Dong Geun Lee, Suwon (KR); Ho Jin Jang, Suwon (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/609,243

(22) PCT Filed: Mar. 2, 2018

(86) PCT No.: PCT/KR2018/002532

§ 371 (c)(1),
(2) Date: Oct. 29, 2019

(87) PCT Pub. No.: WO2019/017554

PCT Pub. Date: Jan. 24, 2019

(65) Prior Publication Data

US 2020/0192247 A1 Jun. 18, 2020

(30) Foreign Application Priority Data

Jul. 18, 2017 (KR) ..... 10-2017-0091064

(51) Int. Cl.
*G03G 15/08* (2006.01)
*G03G 21/10* (2006.01)

(52) U.S. Cl.
CPC ..... *G03G 15/0893* (2013.01); *G03G 15/0844* (2013.01); *G03G 21/105* (2013.01)

(58) Field of Classification Search
CPC ..... G03G 15/0844; G03G 15/105; G03G 15/0893
See application file for complete search history.

(56) References Cited

U.S. PATENT DOCUMENTS

2009/0232543 A1 9/2009 Urasawa et al.
2010/0215401 A1 8/2010 Fujiwara et al.
(Continued)

FOREIGN PATENT DOCUMENTS

JP 2006250973 9/2006
JP 2006258860 9/2006
(Continued)

*Primary Examiner* — Gregory H Curran
(74) *Attorney, Agent, or Firm* — Trop Pruner & Hu, P.C.

(57) ABSTRACT

A developing device includes a developer transport path through which a developer is agitated and transported, a developing roller mounted in the developer transport path, a discharging unit extending from the developer transport path in a length direction of the developing roller, the discharging unit including an air outlet from which air is discharged and a developer discharge outlet from which the developer is discharged, and a separating member mounted in the discharging unit to separate an inner portion of the discharging unit into an air discharge path, connecting the developer transport path and the air outlet, and a developer discharge path, connecting the developer transport path and the developer discharge outlet.

22 Claims, 9 Drawing Sheets

(56) References Cited

U.S. PATENT DOCUMENTS

| | | | | |
|---|---|---|---|---|
| 2014/0205311 | A1* | 7/2014 | Kashimoto ..... | G03G 15/0898 399/98 |
| 2016/0306291 | A1 | 10/2016 | Kuroda et al. | |
| 2017/0248868 | A1* | 8/2017 | Iwata ..... | G03G 15/0812 |

FOREIGN PATENT DOCUMENTS

| | | |
|---|---|---|
| JP | 4674798 | 4/2011 |
| JP | 2013186306 A | 9/2013 |

* cited by examiner

[Fig. 1]
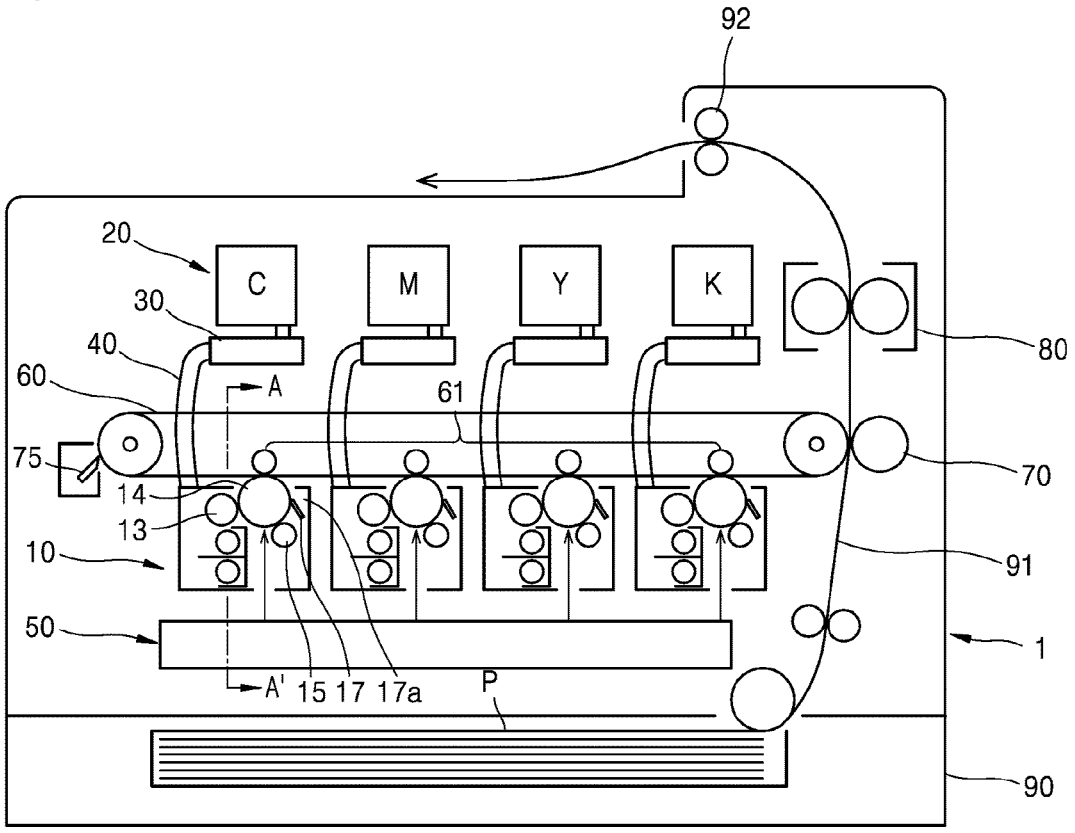

[Fig. 2]
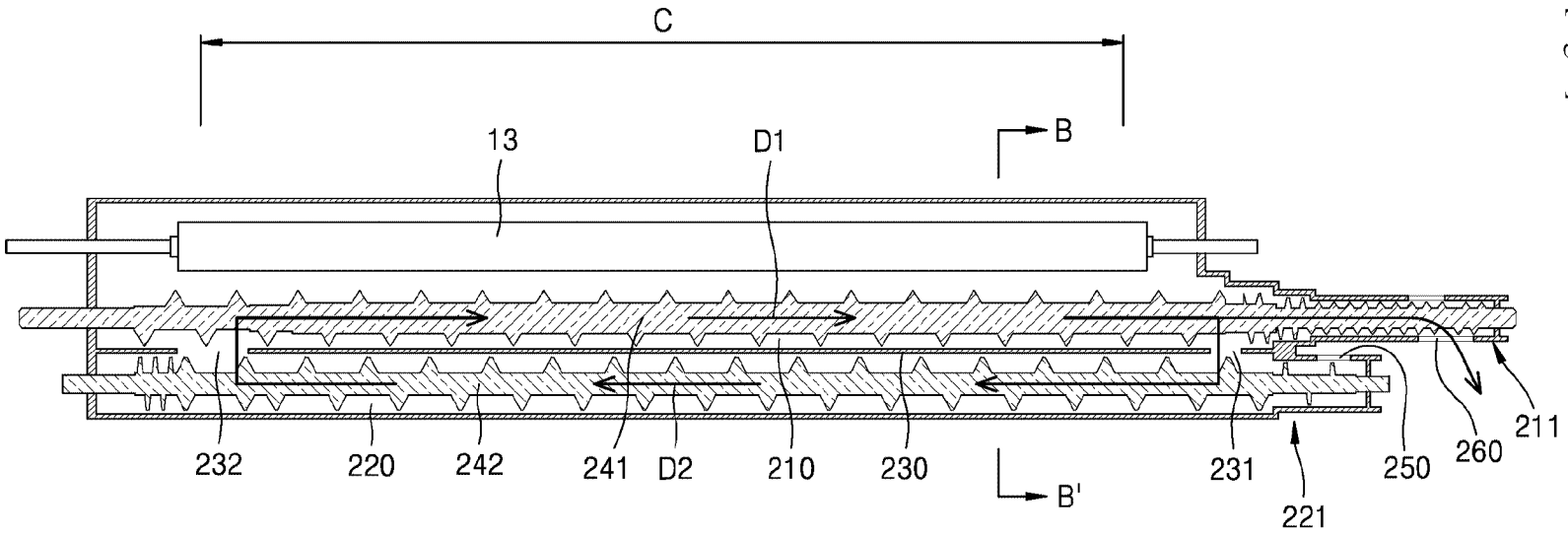

[Fig. 3]
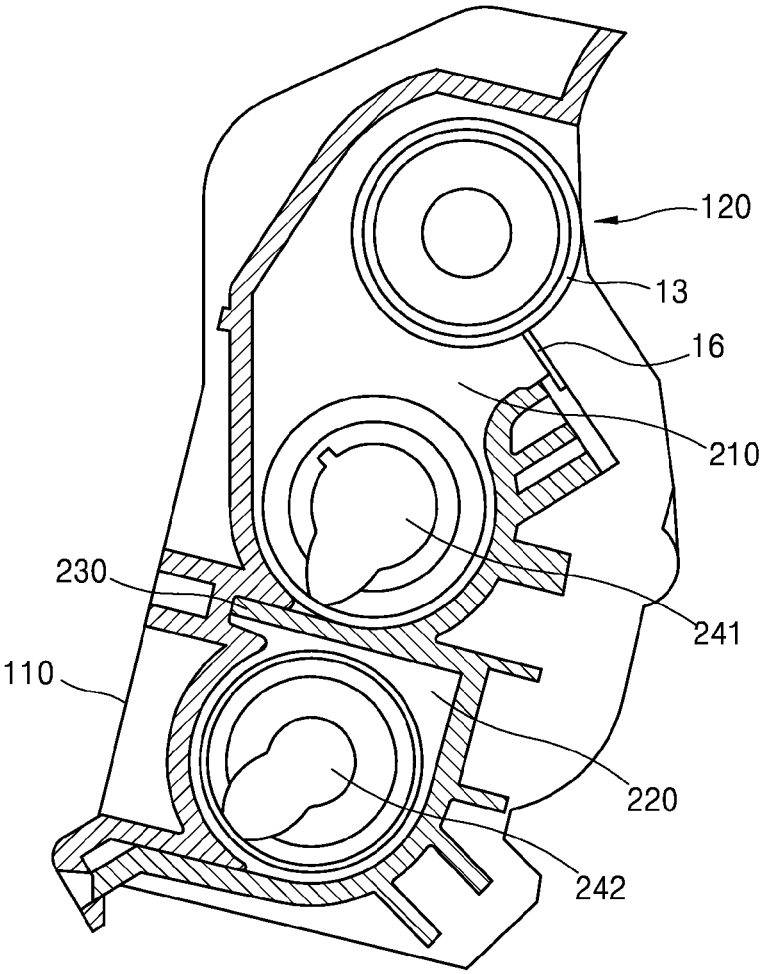
[Fig. 4]
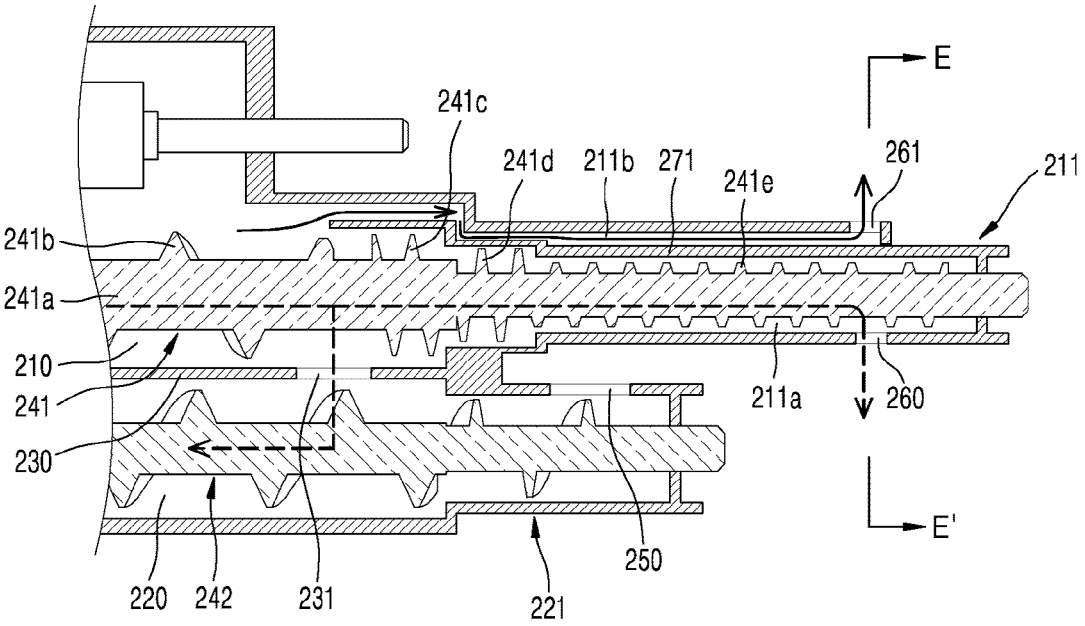

[Fig. 5]
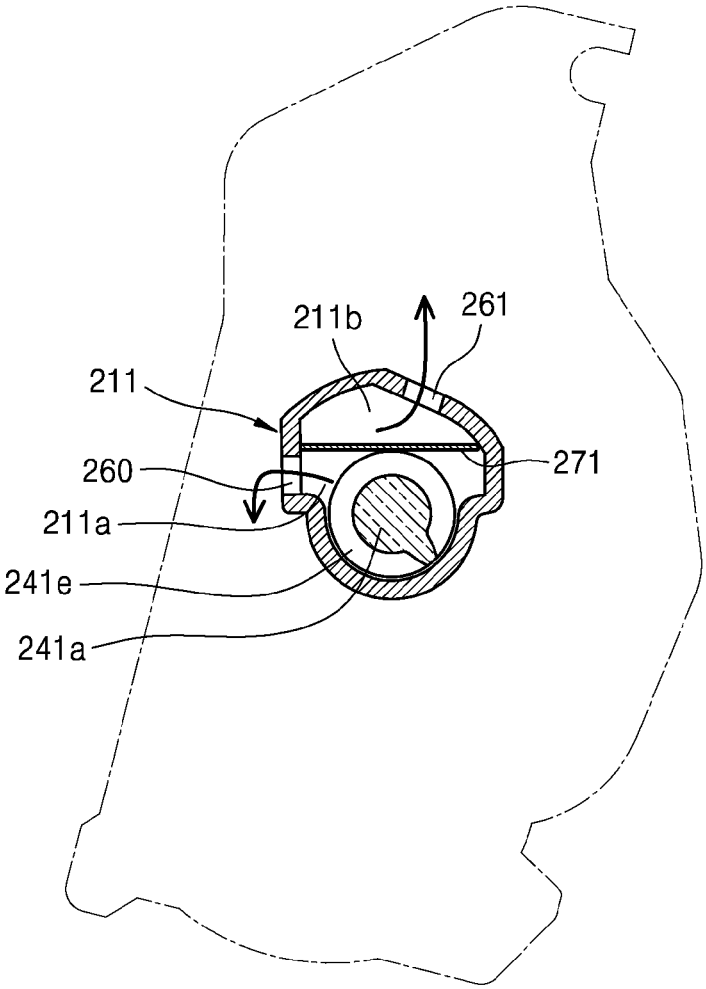

[Fig. 6]
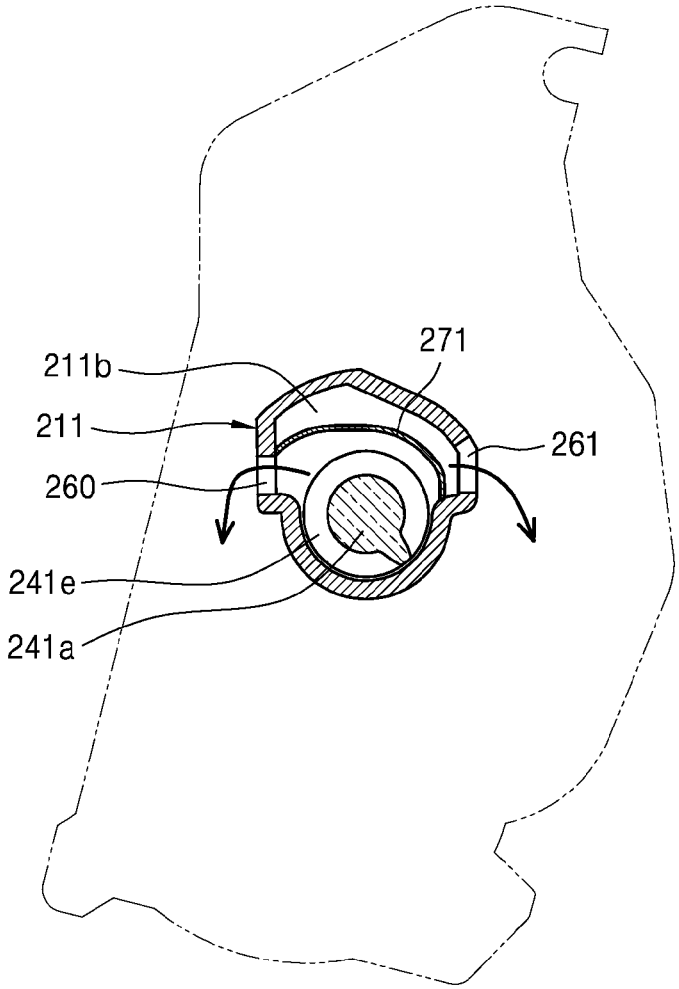

[Fig. 7]
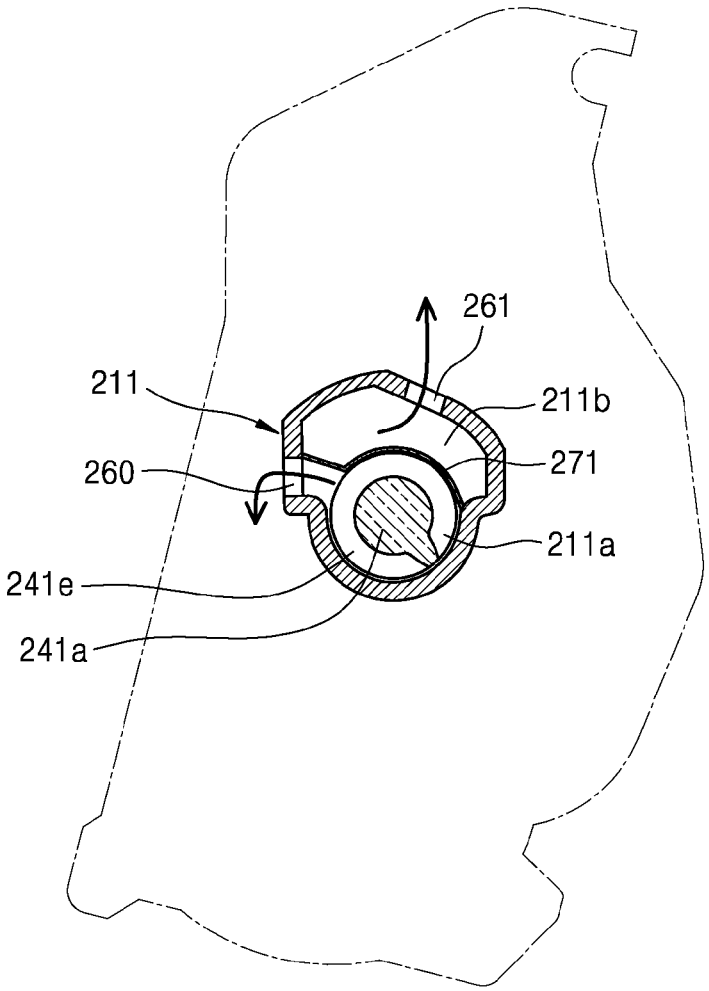
[Fig. 8]
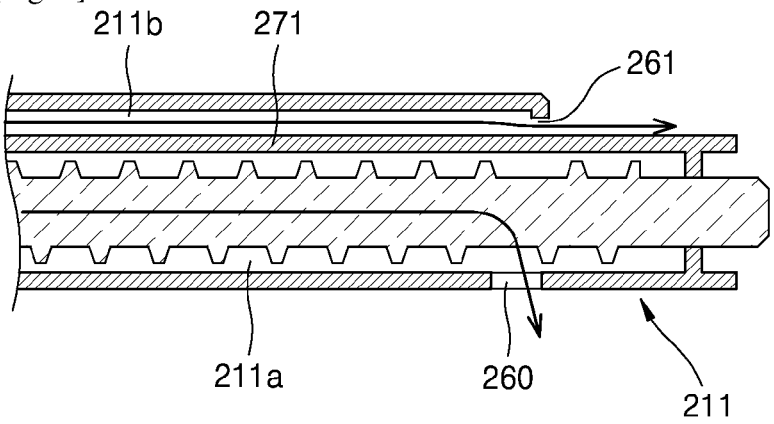

[Fig. 9]
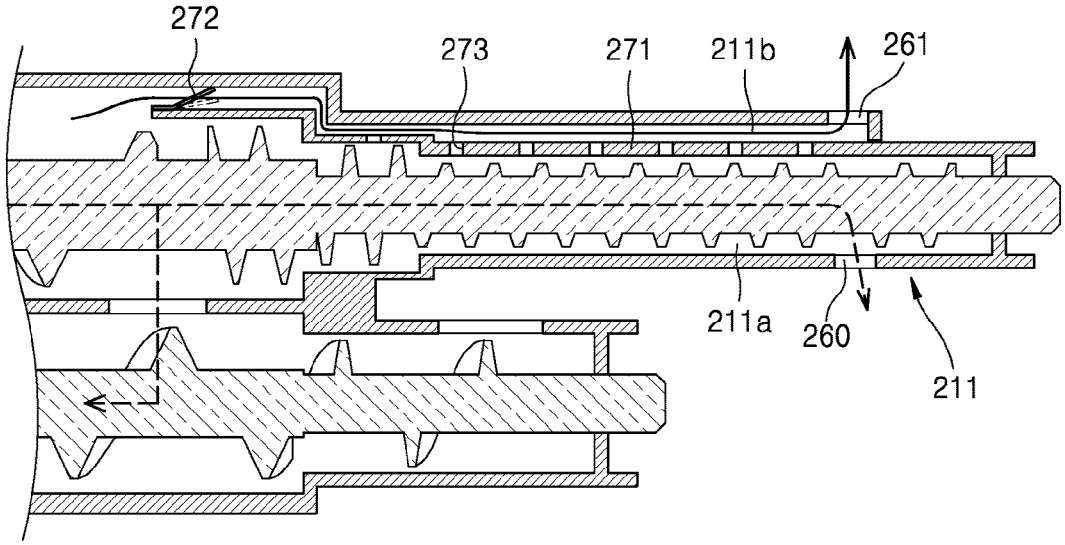
[Fig. 10]
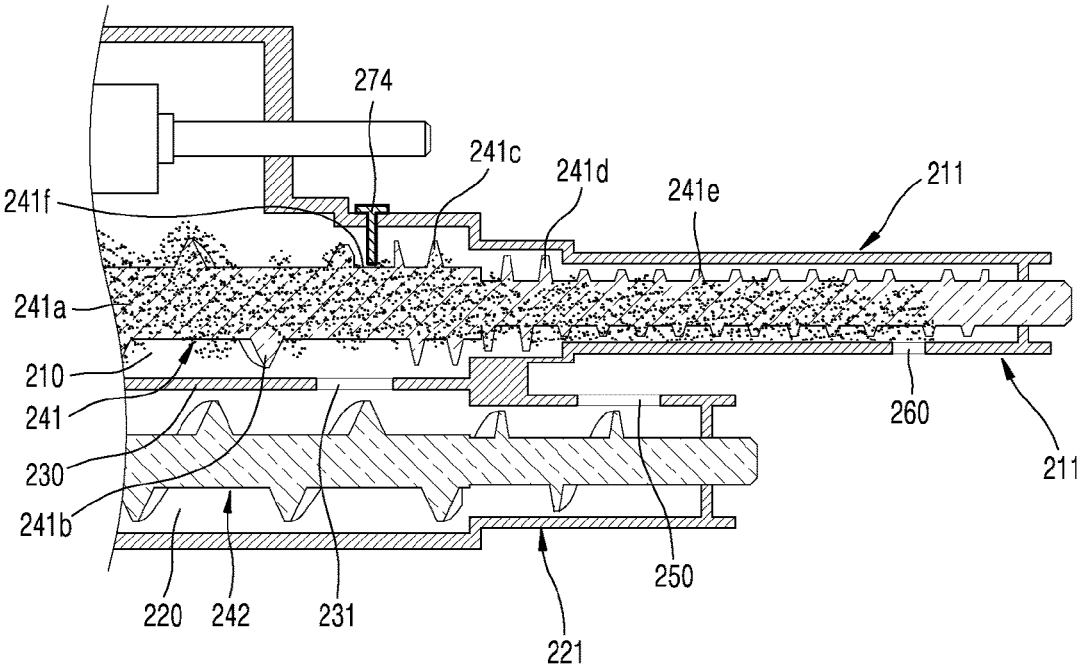

[Fig. 11]
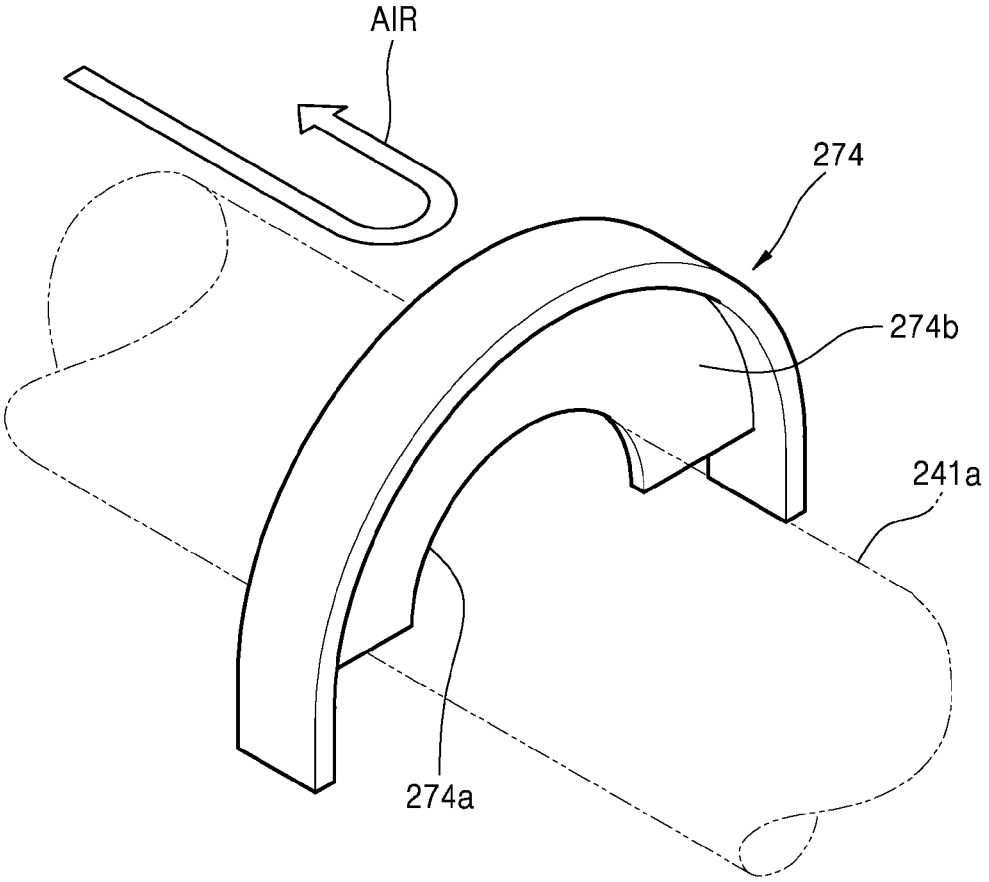
[Fig. 12]
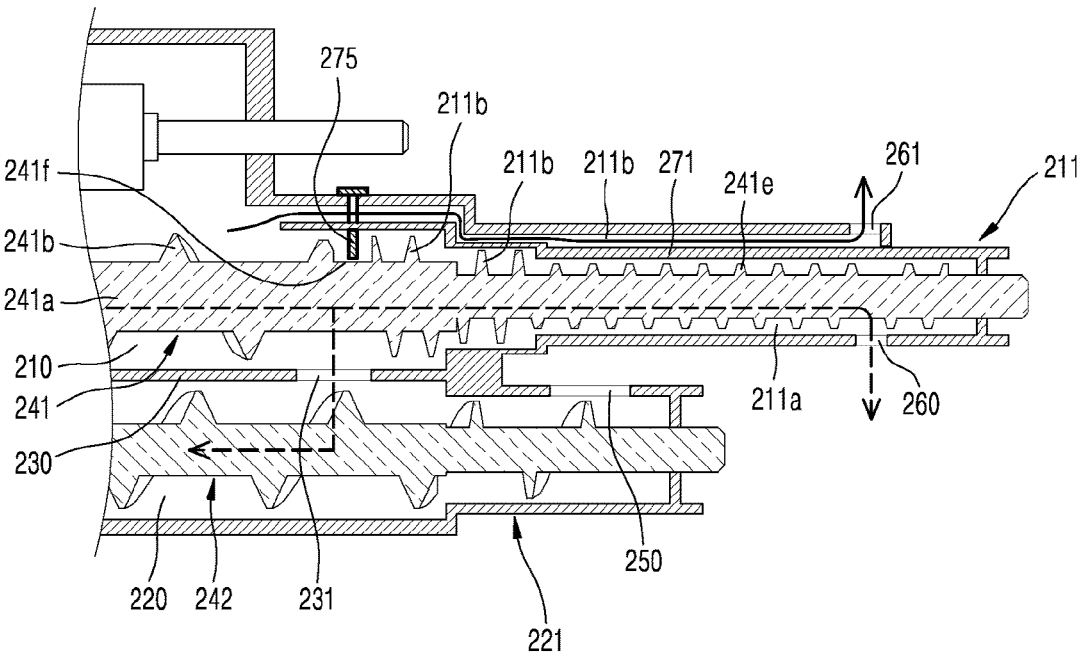

[Fig. 13]
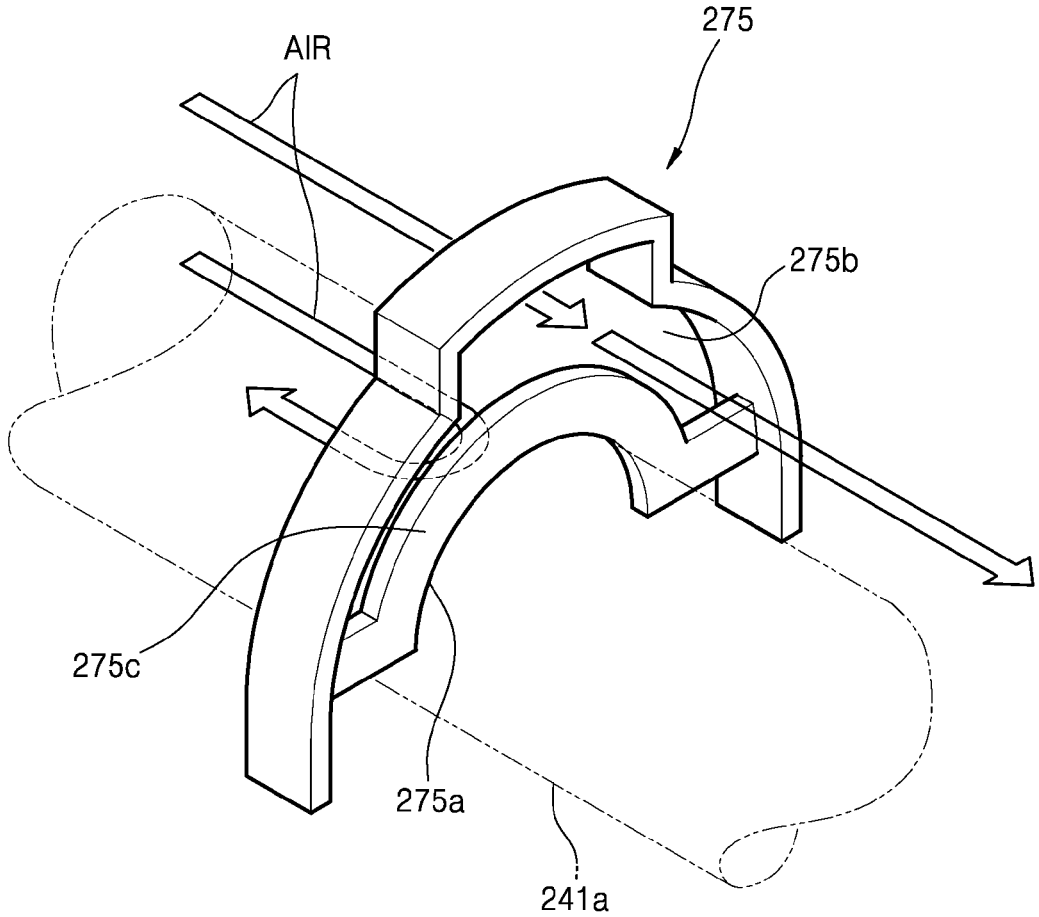
[Fig. 14]
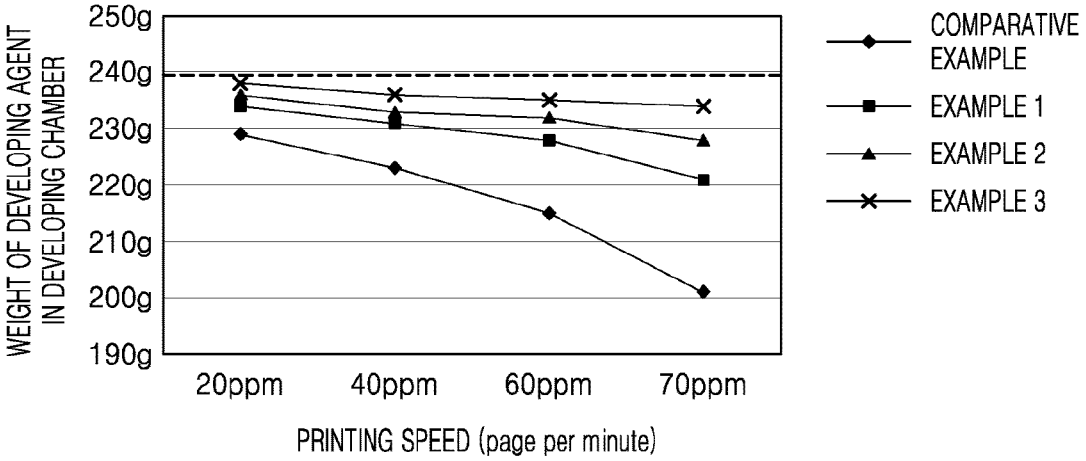

DEVELOPING DEVICE HAVING AN AIR DISCHARGE PATH

BACKGROUND ART

An image forming apparatus using an electrophotographic method supplies toner to an electrostatic latent image formed on a photosensitive body to form a toner image, transfers the toner image onto a recording medium, and fixes the transferred toner image on the recording medium so as to print an image on the recording medium. A developing device accommodates toner, and supplies the toner to the electrostatic latent image formed on the photosensitive body to form a visible toner image on the photosensitive body.

Examples of a development method are a mono-component development method in which only a toner is used as a developer, and a dual-component development method in which a toner and a carrier are used as a developer. When the dual-component development method is used, the performance of carriers in a developing device may be degraded due to repetitive use. Considering this, a trickle development method in which a new developer is supplied into the developing device, and a residual developer is discharged from the developing device, may be used.

BRIEF DESCRIPTION OF DRAWINGS

These and/or other aspects will become apparent and more readily appreciated from the following description of the examples, taken in conjunction with the accompanying drawings in which:

FIG. 1 is a schematic structural diagram of an electrophotographic image forming apparatus according to an example;

FIG. 2 is a cross-sectional view of a developing device illustrated in FIG. 1 taken along line A-A' according to an example;

FIG. 3 is a cross-sectional view of the developing device illustrated in FIG. 2 taken along line B-B' according to an example;

FIG. 4 is a view of a discharging unit illustrated in FIG. 2 according to an example;

FIG. 5 is a cross-sectional view of the discharging unit of FIG. 4 taken along line E-E' according to an example;

FIG. 6 is a cross-sectional view of the discharging unit of FIG. 4 taken along line E-E according to an example;

FIG. 7 is a cross-sectional view of the discharging unit of FIG. 4 taken along line E-E' according to an example;

FIG. 8 is a cross-sectional view of a discharging unit according to an example;

FIG. 9 is a cross-sectional view of a discharging unit according to an example;

FIG. 10 is a cross-sectional view of a discharging unit according to an example;

FIG. 11 is a schematic perspective view of an air blocking member according to an example;

FIG. 12 is a cross-sectional view of a discharging unit according to an example;

FIG. 13 is a schematic perspective view of an air blocking member according to an example; and FIG. 14 is a graph showing a result of measuring an amount of a developer in a developing chamber after printing 1000 sheets by varying a printing speed according to an example.

MODE FOR THE INVENTION

Reference will now be made to examples, which are illustrated in the accompanying drawings, wherein like reference numerals refer to like elements throughout. In this regard, the present examples may have different forms and should not be construed as being limited to the descriptions set forth herein. Accordingly, the examples are merely described below, by referring to the figures, to explain various aspects. As used herein, the term "and/or" includes any and all combinations of one or more of the associated listed items. Expressions such as "at least one of," when preceding a list of elements, modify the entire list of elements and do not modify the individual elements of the list.

Hereinafter, a developing device and an electrophotographic image forming apparatus including the developing device will be described with regard to examples and with reference to the attached drawings. In the present specification and the drawings, elements having substantially the same functions will be labeled with like reference numerals to omit repeated description.

FIG. 1 is a schematic structural view of an electrophotographic image forming apparatus according to an example. The electrophotographic image forming apparatus according to the present example prints a color image by using an electrophotographic method. That is, the image forming apparatus according to the present example is a color image forming apparatus.

Referring to FIG. 1, the image forming apparatus includes a plurality of developing devices 10, an exposure device 50, a transfer device, and a fixing device 80.

The image forming apparatus may further include a plurality of developer cartridges 20 accommodating a developer. The plurality of developer cartridges 20 are respectively connected to the plurality of developing devices 10, and the developer accommodated in the plurality of developer cartridges 20, that is, toner and carrier, is supplied to each of the developing devices 10. The plurality of developer cartridges 20 and the plurality of developing devices 10 are attachable to and detachable from a main body 1 and are individually replaceable.

The plurality of developing devices 10 may include a plurality of developing devices 10C, 10M, 10Y, and 10K that are used to form toner images of cyan (C), magenta (M), yellow (Y), and black (K) colors. In addition, the plurality of developer cartridges 20 may include a plurality of developer cartridges 20C, 20M, 20Y, and 20K respectively accommodating developers of cyan (C), magenta (M), yellow (Y), and black (K) colors to be supplied to the plurality of developing devices 10C, 10M, 10Y, and 10K. However, the scope of the present disclosure is not limited thereto, and additional developer cartridges 20 and developing devices 10 may be included to accommodate and develop developers of other various colors such as light magenta or white in addition to the above-described colors. Hereinafter, an image forming apparatus including the plurality of developing devices 10C, 10M, 10Y, and 10K and the plurality of developer cartridges 20C, 20M, 20Y, and 20K will be described, and unless otherwise described, elements labeled C, M, Y, or K below respectively refer to elements for developing developers of cyan (C), magenta (M), yellow (Y), and black (K) colors.

The developing devices 10 may each include a photosensitive drum 14, on a surface of which an electrostatic latent image is formed, and a developing roller 13 supplying a developer to the electrostatic latent image to develop the electrostatic latent image into a visible toner image. The photosensitive drum 14 is an example of a photosensitive body, on a surface of which an electrostatic latent image is formed, and may include a conductive metal pipe and a photosensitive layer formed on an outer circumference thereof. A charging roller 15 is an example of a charging device charging the photosensitive drum 14 to have a uniform surface potential. Instead of the charging roller 15, a charging brush, a corona charging device, or the like may also be used.

Although not illustrated in FIG. 1, the developing devices 10 may further include a charging roller cleaner for removing a developer or foreign substances such as dust attached on the charging roller 15, a cleaning member 17 removing a developer remaining on a surface of the photosensitive drum 14 after an intermediate transfer process to be described later, and a regulation member regulating an amount of a developer supplied to a developing region in which the photosensitive drum 14 and the developing roller 13 face each other. Waste developer is accommodated in a waste developer accommodating unit 17*a*. The cleaning member 17 may be, for example, a cleaning blade that contacts a surface of the photosensitive drum 14 to scrape the developer. Although not illustrated in FIG. 1, the cleaning member 17 may be a cleaning brush that rotates to contact a surface of the photosensitive drum 14 and scrape the developer.

The developing roller 13 is spaced apart from the photosensitive drum 14. A distance between an outer circumferential surface of the developing roller 13 and an outer circumferential surface of the photosensitive drum 14 may be, for example, several tens to about several hundreds of microns. The developing roller 13 may be a magnetic roller. In addition, the developing roller 13 may have a form in which a magnet is disposed in a rotating developing sleeve. In the developing device 10, toner is mixed with a carrier, and the toner is attached to a surface of a magnetic carrier. The magnetic carrier is attached to a surface of the developing roller 13 and transported to the developing region in which the photosensitive drum 14 and the developing roller 13 face each other. A regulating member (e.g., regulating member 16 shown in FIG. 3) regulates an amount of the developer transported to the developing region. Via a developing bias voltage applied between the developing roller 13 and the photosensitive drum 14, only the toner is supplied to the photosensitive drum 14 so as to develop an electrostatic latent image formed on a surface of the photosensitive drum 14 into a visible toner image. A trickle development method is used in the developing device 10 according to the present example. In order to maintain a uniform amount of developer in the developing device 10, residual developer is discharged out of the developing device 10.

The exposure device 50 radiates light modulated according to image information, onto the photosensitive drum 14, to thereby form an electrostatic latent image on the photosensitive drum 14. Examples of the exposure device 50 may be a laser scanning unit (LSU) using a laser diode as a light source or a light-emitting diode (LED) exposure device that uses an LED as a light source.

The transfer device transfers the toner image formed on the photosensitive drum 14, onto a recording medium P. In the present example, a transfer device that uses an intermediate transfer method is used. For example, the transfer device may include an intermediate transfer belt 60, a plurality of intermediate transfer rollers 61, and a transfer roller 70.

The intermediate transfer belt 60 temporarily accommodates the toner image developed on the photosensitive drum 14 of the plurality of developing devices 10C, 10M, 10Y, and 10K. The plurality of intermediate transfer rollers 61 are disposed to face the photosensitive drum 14 of the plurality of developing devices 10C, 10M, 10Y, and 10K, with the intermediate transfer belt 60 therebetween. An intermediate transfer bias used to intermediately transfer the toner image developed on the photosensitive drum 14, to the intermediate transfer belt 60, is applied to the plurality of intermediate transfer rollers 61. Instead of the intermediate transfer rollers 61, a corona transfer device, a pin scorotron transfer device, or the like may be used.

The transfer roller 70 is disposed to face the intermediate transfer belt 60. A transfer bias for transferring the toner image transferred to the intermediate transfer belt 60, to the recording medium P, is applied to the transfer roller 70. In addition, a cleaning member 75 that removes the developer remaining on a surface of the intermediate transfer belt 60 after the toner image is transferred to the recording medium P may be included. The cleaning member 75 may be, for example, a cleaning blade that contacts a surface of the intermediate transfer belt 60 to scrape the developer. Although not illustrated in FIG. 1, the cleaning member 75 may be a cleaning brush that rotates to contact the surface of the intermediate transfer belt 60 and scrape the developer.

The fixing device 80 fixes the toner image transferred to the recording medium P, on the recording medium P by applying heat and/or pressure to the toner image. The form of the fixing device 80 is not limited to that illustrated in FIG. 1.

According to the above-described configuration, the exposure device 50 radiates light modulated according to image information of the colors onto the photosensitive drum 14 of the plurality of developing devices 10C, 10M, 10Y, and 10K to form an electrostatic latent image on the photosensitive drum 14. The electrostatic latent image of the photosensitive drum 14 of the plurality of developing devices 10C, 10M, 10Y, and 10K is developed into a visible toner image by using the C, M, Y, and K developers supplied from the plurality of developer cartridges 20C, 20M, 20Y, and 20K to the plurality of developing devices 10C, 10M, 10Y, and 10K. The developed toner images are sequentially intermediately transferred to the intermediate transfer belt 60. The recording medium P loaded in a feeding unit 90 is transported along a feeding path 91 between the transfer roller 70 and the intermediate transfer belt 60. Due to a transfer bias voltage applied to the transfer roller 70, the toner images that are intermediately transferred onto the intermediate transfer belt 60 are transferred to the recording medium P. When the recording medium P passes through the fixing device 80, the toner images are fixed to the recording medium P by heat and pressure. The recording medium P, with which fixing is completed, is discharged using a discharge roller 92.

The developer accommodated in the developer cartridge 20 is supplied to the developing device 10. When the developer accommodated in the developer cartridge 20 is completely consumed, the developer cartridge 20 may be replaced with a new developer cartridge 20, or a new developer may be filled in the developer cartridge 20.

The image forming apparatus may further include a developer supply unit 30. The developer supply unit 30 receives a developer from the developer cartridge 20 and supplies the same to the developing device 10. The developer supply unit 30 is connected to the developing device 10 via a supply pipe line 40. Although not illustrated in FIG. 1, the developer supply unit 30 may be omitted, and the supply pipe line 40 may directly connect the developer cartridge 20 and the developing device 10.

FIG. 2 is a cross-sectional view of a developing device illustrated in FIG. 1 taken along line A-A' according to an example. FIG. 3 is a cross-sectional view of the developing device illustrated in FIG. 2 taken along line B-B' according to an example.

Referring to FIGS. 2 and 3, the developing device 10 includes a development casing 110 and the developing roller 13 that is rotatably supported by the development casing 110. A developer is accommodated in the development casing 110. The developer described above may be supplied from the developer cartridge 20.

A developer transport path may be included in the development casing 110. The developer is transported along the developer transport path, and is agitated. The developing roller 13 is mounted in the developer transport path. The developer transport path may include a developing chamber 210. An opening portion 120 opened towards the photosensitive drum 14 is formed in the developing chamber 210. The developing roller 13 is mounted in the developing chamber 210. The developing roller 13 is at least partially exposed to an environment outside of the developing chamber 210 through the opening 120, and an exposed portion of the developing roller 13 faces the photosensitive drum 14. The developing roller 13 supplies the toner accommodated in the developing chamber 210 to an electrostatic latent image formed on the photosensitive drum 14, through the opening portion 120, thereby developing the electrostatic latent image into a toner image. A regulating member 16 regulates an amount of the developer.

The developer transport path may further include an agitating chamber 220. The agitating chamber 220 is divided from the developing chamber 210 via a barrier wall 230. First and second agitating members 241 and 242 may be included in the developing chamber 210 and the agitating chamber 220, respectively. The first and second agitating members 241 and 242 transport a developer in each of the developing chamber 210 and the agitating chamber 220 in a length direction of the developing roller 13, thereby agitating the toner and the carrier. The first and second agitating members 241 and 242 may be, for example, augers having spiral wings. The first and second agitating members 241 and 242 transport the developer in opposite directions to each other. For example, the first and second agitating members 241 and 242 may transport the developer in a first direction D1 and a second direction D2, respectively. First and second flue holes 231 and 232 are respectively formed in two end portions of the barrier wall 230 in a length direction, to thereby communicatively connect the developing chamber 210 and the agitating chamber 220. Accordingly, via the first agitating member 241, the developer in the developing chamber 210 is transported in the first direction D1. The developer is transported to the agitating chamber 220 through the first flue hole 231 formed in an end portion of the barrier wall 230 in the first direction D1. The developer in the agitating chamber 220 is transported by the second agitating member 242 in the second direction D2. The developer is transported to the developing chamber 210 through the second flue hole 232 formed in an end portion of the barrier wall 230 in the second direction D2. According to this configuration, the developer is circulated through a circulation passage in which the developing chamber 210, the first flue hole 231, the agitating chamber 220, the second flue hole 232, and the developing chamber 210 again are sequentially included. A portion of the developer transported in the developing chamber 210 in the first direction is attached to the developing roller 13 so as to be supplied to the photosensitive drum 14.

The developing device 10 according to the present example includes a developer supply inlet 250. The developer may be supplied from the developer cartridge 20 through the developer supply inlet 250 into the developing device 10, that is, into the developer transport path. The developer supply inlet 250 may be provided in an outer portion of an effective image area C of the developing roller 13. The effective image area C refers to an area that is effectively used in forming an image, from a length of the developing roller 13. A length of the effective image area C may be slightly greater than a width of the recording medium P of an available maximum size. The effective image area C may be an inner portion with respect to the first flue hole 231 and the second flue hole 232. The developer supply inlet 250 may be located in an outer portion of one of the first flue hole 231 and the second flue hole 232.

According to an example, the developing device 10 may include a supply unit 221 extending from the developer transport path in a length direction of the developing roller 13. The developer supply inlet 250 may be provided in the supply unit 221. For example, the supply unit 221 may extend from the agitating chamber 220 beyond the first flue hole 231 to an outer portion of the effective image area C in the first direction D1. The second agitating member 242 extends to an inner portion of the supply unit 221. The developer supplied to the agitating chamber 220 through the developer supply inlet 250 is transported in the second direction D2 by using the second agitating member 242. Although not illustrated in the drawings, the supply unit 221 may extend from the agitating chamber 220 beyond the second flue hole 232 in the second direction D2. In this case, a structure for transporting the developer in the first direction D1, for example, a reverse spiral wing, may be provided in an area of the second agitating member 242 corresponding to the supply unit 221. The developer supplied to the agitating chamber 220 through the developer supply inlet 250 may be transported in the first direction D1 via the reverse spiral wing, and transported to the developing chamber 210 through the second flue hole 232.

The developing device 10 according to the present example, in which a trickle development method is used, includes a developer discharge outlet 260. Residual developer is discharged out of the developing device 10 through the developer discharge outlet 260. The discharged residual developer is accommodated in a waste developer container (not shown). The developer discharge outlet 260 is located in an outer portion of the effective image area C of the developing roller 13. The developer discharge outlet 260 may be located in an outer portion of one of the first flue hole 231 and the second flue hole 232.

According to an example, the developing device 10 may include a discharging unit 211 extending from the developer transport path in a length direction of the developing roller 13. The developer discharge outlet 260 may be provided in the discharging unit 211. For example, the discharging unit 211 may extend from the developing chamber 210 in the first direction D1 toward an outer portion of the effective image area C. The first agitating member 241 extends toward an inner portion of the discharging unit 211. Residual developer may be transported by the first agitating member 241 and discharged out of the developing device 10 through the developer discharge outlet 260.

When the developer is discharged through the developer discharge outlet 260, the air in the developing chamber 210 is also discharged. The faster a printing speed of the image forming apparatus, the faster a rotational speed of the developing roller 13. In that case, a speed of the air inflow from the outside into the developing chamber 210 and an amount of air in the developing chamber 210 are increased.

Also, the air pressure in the developing chamber 210 and a discharge pressure of the air through the developer discharge outlet 260 are increased. The discharge pressure of the air increases a discharging speed of the developer through the developer discharge outlet 260, which may cause an excessive discharge of the developer. The excessive discharging of the developer may excessively reduce the amount of the developer in the developing chamber 210, which makes the amount of the developer in the developing chamber 210 fall below an appropriate level, and this in turn may lower an image quality, such as by reduced image density.

An air outlet may be additionally provided in the discharging unit 211. However, even then, if an internal pressure in the developing chamber 210 increases, the developer may be discharged with the air through the air outlet, making it difficult to maintain an appropriate level of the developer. Also, scattering of the developer may be caused in the image forming apparatus, which may cause contamination.

The developing device 10 according to the present example includes an air outlet in the discharging unit 211 in addition to the developer discharge outlet 260, but an air discharge path is separated from a developer discharge path. Accordingly, the influence of the air pressure in the developing chamber 210 on the amount of discharged developer through the developer discharge outlet 260 due to the air pressure may be reduced, and discharging of the developer through the air outlet may be reduced, thereby stably maintaining the amount of the developer in the developing chamber 210 and also reducing scattering of the developer.

FIG. 4 is a view of a discharging unit illustrated in FIG. 2 according to an example. FIGS. 5, 6, and 7 are cross-sectional views of the discharging unit of FIG. 4 taken along line E-E' according to examples.

Referring to FIGS. 4 and 5, the discharging unit 211 extends from the developing chamber 210 in the first direction D1. The first agitating member 241 includes a rotational axis 241*a* (e.g., a shaft, rod, etc.) and a normal direction spiral wing 241*b* formed on an outer circumference of the rotational axis 241*a*. The normal direction spiral wing 241*b* is located inside the developing chamber 210. The normal direction spiral wing 241*b* transports the developer in the first direction D1.

The rotational axis 241*a* extends into the discharging unit 211. A reverse spiral wing 241*c* is formed on the rotational axis 241*a*. The reverse spiral wing 241*c* is located inside the discharging unit 211, and on a path in the first direction D1 of the normal direction spiral wing 241*b*. The reverse spiral wing 241*c* is located near the first flue hole 231. The reverse spiral wing 241*c* is located on a path in the first direction D1 of the first flue hole 231. The reverse spiral wing 241*c* transports the developer in the second direction D2. A pitch of the reverse spiral wing 241*c* may be less than a pitch of the normal direction spiral wing 241*b*. According to this configuration, a transporting speed of the developer being transported by the normal direction spiral wing 241*b* in the first direction D1 is lowered around the first flue hole 231. Accordingly, the developer may be easily transported to the agitating chamber 220 from the developing chamber 210 through the first flue hole 231. In addition, the reverse spiral wing 241*c* prevents an excessive amount of the developer from flowing into the discharging unit 211.

A discharge spiral wing for transporting the developer in the first direction D1 may be disposed on a path of the reverse spiral wing 241*c* in the first direction D1. The discharge spiral wing may have various structures. For example, the discharge spiral wing may include a first discharge spiral wing 241*d* and a second discharge spiral wing 241*e* sequentially arranged in the first direction D1. The first and second discharge spiral wings 241*d* and 241*e* transport the developer in the first direction D1. A diameter of the second discharge spiral wing 241*e* may be less than a diameter of the first discharge spiral wing 241*d*. The first and second discharge spiral wings 241*d* and 241*e* may have smaller diameters than that of the normal direction spiral wing 241*b*. According to this configuration, a flow of the developer in the first direction D1 is partially blocked by the reverse spiral wing 241*c*, and, is partially blocked again by the first and second discharge spiral wings 241*d* and 241*e* having a smaller transporting capability in the first direction D1 than the normal direction spiral wing 241*b*. Accordingly, only an amount of the developer exceeding an appropriate level in the developing chamber 210 flows over the reverse spiral wing 241*c* to enter the discharging unit 211 and is transported in the first direction D1 by the first and second discharge spiral wings 241*d* and 241*e* and discharged through the developer discharge outlet 260.

The developing device 10 according to the present example further includes an air outlet 261. The air outlet 261 is formed in the discharging unit 211. In order to reduce mixing between the developer and the air and to separately discharge the air and the developer, the discharging unit 211 is divided into a developer discharge path 211*a* and an air discharge path 211*b* by using a separating member 271. The separating member 271 extends in the discharging unit 211 in an extension direction of the discharging unit 211, that is, in the first direction D1. The developer in the discharging unit 211 is transported to the developer discharge outlet 260 mainly through a lower portion of the discharging unit 211 with respect to a gravitational direction. The air in the discharging unit 211 is located mainly at an upper portion of the discharging unit 211 with respect to a gravitational direction. Thus, the developer discharge path 211*a* and the air discharge path 211*b* may be located at a lower portion and an upper portion of the discharging unit 211 with respect to a gravitational direction, respectively. A first end portion of the developer discharge path 211*a* is connected to the developing chamber 210, and a second end portion thereof is connected to the developer discharge outlet 260. A first end portion of the air discharge path 211*b* is connected to the developing chamber 210, and a second end portion thereof is connected to the air outlet 261.

According to this configuration, even if the air pressure in the developing chamber 210 increases, the air is discharged to the outside through the air outlet 261. Accordingly, the influence of the air pressure in the developing chamber 210 on a discharging speed and an amount of the developer discharged through the developer discharge outlet 260 may be reduced, and an appropriate level of the amount of the developer in the developing chamber 210 may be maintained. In addition, as the air discharge path 211*b* and the developer discharge path 211*a* are separated from each other by the separating member 271, the amount of the developer being discharged with the air through the air outlet 261 may be reduced. Accordingly, an appropriate level of the amount of the developer in the developing chamber 210 may be maintained, and scattering of the developer into the image forming apparatus may be reduced.

In addition, as the developer discharge path 211*a* and the air discharge path 211*b* are separated, the degree of freedom regarding installation locations of the developer discharge outlet 260 and the air outlet 261 is high. Thus, the design freedom of the developing device 10 is high, and the developing device 10 having various printing speeds and structures may be designed.

If the air pressure in the developing chamber 210 has increased, or a condition is met that a flow of the developer in the developing chamber 210 increases a level of the developer in the developing chamber 210 due to environmental factors such as temperature, humidity or the like, the air pressure may be a factor contributing to an increase in a discharging speed and a discharging amount of the developer through the developer discharge outlet 260. According to the present example, by separating the developer discharge path 211*a* and the air discharge path 211*b*, the increase in the air pressure due to the environmental factors and the increase in the amount of discharged developer may be prevented.

Referring to FIGS. 4, 5, and 6, the separating member 271 is spaced apart from the reverse spiral wing 241*c*, the first discharging spiral wing 241*d*, and the second discharging spiral wing 241*e* of the first agitating member 241. Further, the separating member 271 may have different configurations such a substantially flat configuration as illustrated in FIG. 5 or a bowed, curved or similar configuration as illustrated in FIG. 6. Still further, as illustrated in FIG. 7, the separating member 271 may elastically contact at least one of the reverse spiral wing 241*c*, the first discharging spiral wing 241*d*, and the second discharging spiral wing 241*e* of the first agitating member 241. In this case, the separating member 271 may be formed of an elastic planar material, such as a film. For example, the separating member 271 may elastically contact the first discharging spiral wing 241*d* and the second discharging spiral wing 241*e*. In addition, the separating member 271 may elastically contact an inner wall of the discharging unit 211. According to this configuration, a large cross-section of the air discharge path 211*b* may be ensured. In addition, the flow of the air into the developer discharge path 211*a* may be prevented via a distance between the separating member 271 and the first discharging spiral wing 241*d* and the second discharging spiral wing 241*e* and the inner wall of the discharging unit 211, and thus, the increase in the air pressure in the developing chamber 210 and the increase in the amount of discharged developer due to the increase in the air pressure may be prevented more effectively.

Referring to FIGS. 5 and 7, the air outlet 261 is located at an upper portion of the discharging unit 211 with respect to a gravitational direction. However, the location of the air outlet 261 is not particularly limited. For example, as illustrated in FIG. 6, the air outlet 261 may be located in a lateral portion of the discharging unit 211.

FIG. 8 is a cross-sectional view of a discharging unit according to an example.

Referring to FIG. 8, the discharging unit 211 extends from the developing chamber in the first direction D1. The developer discharge outlet 260 may be provided in the discharging unit 211 and the discharging unit 211 is divided into the developer discharge path 211*a* and the air discharge path 211*b* by the separating member 271. In the example of FIG. 8, the air outlet 261 may be located at an end portion of the air discharge path 211*b* in the first direction D1.

FIG. 9 is a cross-sectional view of a discharging unit according to an example.

Referring to FIG. 9, a developer blocking member 272 blocking discharge of the developer through the air outlet 261 is mounted in the air discharge path 211*b*. The developer blocking member 272 may be mounted at an arbitrary location between an end portion of the air discharge path 211*b* at the developing chamber 210 and an end portion of the air discharge path 211*b* at the air outlet 261. In the present example, the developer blocking member 272 is located at the end portion of the air discharge path 211*b* at the developing chamber 210. The developer blocking member 272, which may be, for example, a valve, may be formed of an elastic film that elastically blocks, for example, the air discharge path 211*b*. The developer blocking member 272 may be pushed by the air discharged according to an amount of pressure in the developing chamber 210, to be elastically bent to thereby open the air discharge path 211*b*. Alternatively, the developer blocking member 272 may be a porous member such as a sponge. According to this configuration, discharging of the developer through the air outlet 261 may be reduced.

Referring to FIG. 9, a plurality of holes 273 may be formed in the separating member 271. Due to its own weight, the developer flowing into the air discharge path 211*b* may fall onto the developer discharge path 211*a* through the plurality of holes 273. According to this configuration, discharge of the developer through the air outlet 261 may be further reduced.

As an example for reducing the influence of the air pressure in the developing chamber 210 on the amount of discharged developer through the developer discharge outlet 260, a structure that reduces air flow into the discharging unit 211 may be considered.

FIG. 10 is a cross-sectional view of a discharging unit according to an example.

Referring to FIG. 10, an air blocking member 274 that partially blocks the air flowing from a developer transport path, for example, the developing chamber 210 into the discharging unit 211 is included. The developer is transported in the discharging unit 211 to the developer discharge outlet 260 mainly through a lower portion of the discharging unit 211 with respect to a gravitational direction. Meanwhile, the air is mainly located at an upper portion of the discharging unit 211 with respect to a gravitational direction. Thus, the air blocking member 274 blocks an upper area of the discharging unit 211 with respect to a gravitational direction. For example, the air blocking member 274 blocks an upper area of the discharging unit 211 with respect to the rotational axis 241*a* of the first agitating member 241.

According to an example, the first agitating member 241 may include the rotational axis 241*a*, the normal direction spiral wing 241*b* included in an area corresponding to the developing chamber 210, and the reverse spiral wing 241*c* located on a path of the normal direction spiral wing 241*b* in the first direction D1. The air blocking member 274 may be between the normal direction spiral wing 241*b* and the reverse spiral wing 241*c*. A spiral wing omitted portion 241*f*, where a spiral wing is omitted so as to expose the rotational axis 241*a*, is formed between the normal direction spiral wing 241*b* and the reverse spiral wing 241*c*.

FIG. 11 is a schematic perspective view of an air blocking member according to an example.

Referring to FIG. 11, the air blocking member 274 may have an approximately semicircular shape, and may include a circular arc portion 274*a* partially surrounding the rotational axis 241*a*, that is, an upper area of the rotational axis 241*a* with respect to a gravitational direction. The circular arc portion 274*a* surrounds an upper area of the spiral wing omitted portion 241*f* with respect to a gravitational direction. The circular arc portion 274*a* is a lower boundary of a blocking portion 274*b*. Due to the blocking portion 274*b*, the air flow through the upper area of the discharging unit 211 with respect to a gravitational direction may be blocked.

According to this configuration, the air heading from the developing chamber 210 to the developer discharge outlet 260 through the discharging unit 211 is blocked by the air blocking member 274. Accordingly, the influence of the air pressure in the developing chamber 210 on a discharging speed and an amount of developer discharged through the developer discharge outlet 260 may be reduced, and an appropriate level of the amount of the developer in the developing chamber 210 may be maintained.

An installation location of the air blocking member 274 is not particularly limited, but the farther the air blocking member 274 is from the developer discharge outlet 260, the influence of the air pressure in the developing chamber 210 on the discharging speed of the developer and the amount of the discharged developer through the developer discharge outlet 260 may be reduced more effectively. The air blocking member 274 may be between the reverse spiral wing 241*c* and the first discharging spiral wing 241*d*, or between the first discharging spiral wing 241*d* and the second discharging spiral wing 241*e*. In addition, the air blocking member 274 may be at an arbitrary location in the discharging unit 211. In this case, the spiral wing omitted portion 241*f* may be provided in an area of the first agitating member 241 corresponding to the location where the air blocking member 274 is mounted. In addition, two or more air blocking members 274 may be arranged in the first direction D1.

The air blocking member 274 illustrated in FIGS. 10 and 11 may also be applied to the discharging unit 211 illustrated in FIG. 4.

FIG. 12 is a cross-sectional view of a discharging unit according to an example.

Referring to FIG. 12, the discharging unit 211 may have the structure illustrated in FIGS. 4 through 9. That is, the discharging unit 211 is divided into the developer discharge path 211*a* and the air discharge path 211*b* by using the separating member 271. Moreover, an air blocking member 275 is mounted in the discharging unit 211. The air blocking member 275 partially blocks the air flowing through a developer transport path, for example, from the developing chamber 210 into the developer discharge path 211*a*. In the developer discharge path 211*a*, the developer is transported to the developer discharge outlet 260 mainly through a lower portion of the developer discharge path 211*a* with respect to a gravitational direction. Air is located in a relatively upper area of the developer discharge path 211*a* with respect to a gravitational direction. Accordingly, the air blocking member 275 blocks an upper area of the developer discharge path 211*a* with respect to a gravitational direction. For example, the air blocking member 275 blocks an upper area of the developer discharge path 211*a* with respect to the rotational axis 241*a* of the first agitating member 241.

According to an example, the first agitating member 241 may include the rotational axis 241*a*, the normal direction spiral wing 241*b* included in an area corresponding to the developing chamber 210, and the reverse spiral wing 241*c* located on a path of the normal direction spiral wing 241*b* in the first direction D1. The air blocking member 275 may be between the normal direction spiral wing 241*b* and the reverse spiral wing 241*c*. The spiral wing omitted portion 241*f*, where a spiral wing is omitted so as to expose the rotational axis 241*a*, is formed between the normal direction spiral wing 241*b* and the reverse spiral wing 241*c*.

FIG. 13 is a schematic perspective view of an air blocking member according to an example.

Referring to FIG. 13, the air blocking member 275 may have an approximately semicircular shape, and may include a circular arc portion 275*a* partially surrounding an upper area of the rotational axis 241*a* with respect to a gravitational direction. The circular arc portion 275*a* surrounds an upper area of the spiral wing omitted portion 241*f* with respect to a gravitational direction. The air blocking member 275 includes a through portion 275*b* used to form the air discharge path 211*b*. Due to a blocking portion 275*c* between the through portion 275*b* and the circular arc portion 275*a*, the air flow through an upper area of the developer discharge path 211*a* with respect to a gravitational direction may be blocked.

An installation location of the air blocking member 275 is not particularly limited, but the farther the installation location of the air blocking member 275 is from the developer discharge outlet 260, the influence of the air pressure in the developing chamber 210 on the discharging speed of the developer and the amount of the discharged developer through the developer discharge outlet 260 may be reduced more effectively. The air blocking member 275 may be between the reverse spiral wing 241*c* and the first discharging spiral wing 241*d*, or between the first discharging spiral wing 241*d* and the second discharging spiral wing 241*e*. In addition, the air blocking member 275 may be at an arbitrary location in the discharging unit 211. In this case, the spiral wing omitted portion 241*f* may be formed in an area of the first agitating member 241 corresponding to the location where the air blocking member 275 is mounted. In addition, two or more air blocking members 275 may be arranged in the first direction D1.

According to this configuration, the air heading from the developing chamber 210 to the developer discharge outlet 260 through the developer discharge path 211*a* is blocked by the air blocking member 275. Accordingly, the influence of the air pressure in the developing chamber 210 on a discharging speed and an amount of the developer discharged through the developer discharge outlet 260 may be reduced, and an appropriate level of the amount of the developer in the developing chamber 210 may be maintained.

Table 1 shows a result of measuring a variation in an amount of the developer in the developing chamber 210 by varying a printing speed. Initially, 240 g of a developer was put in the developing chamber 210. The developing device 10 was operated for 90 minutes according to printing speeds, and then an amount of the developer in the developing chamber 210 was measured. In Table 1, a comparative example denotes a structure in which the separating member 271 and the air blocking member 274 or 275 are not applied. Example 1 denotes a structure in which the separating member 271 is included (FIG. 4, FIG. 5), Example 2 denotes a structure in which the separating member 271 and the air blocking member 275 are included (FIG. 12), and Example 3 denotes a structure in which the cross-section of the air discharge path 211*b* of Example 1 is doubled. In Example 3, the size of the air outlet 261 is twice the size of that of Example 1. An evaluation result was marked as bad, good, and very good Rank 1 indicates the best result (the least change in the amount of the developer), and Rank 5 indicates the worst result (the largest change in the amount of the developer). In Table 1, according to the developing device 10 of the present example, the amount of the developer in the developing chamber 210 may be stably maintained.

TABLE 1

| | Printing speed | | | | Evaluation |
|---|---|---|---|---|---|
| | 20 ppm | 40 ppm | 60 ppm | 70 ppm | result |
| Comparative example | 229 g | 223 g | 215 g | 201 g | Bad (Rank5) |
| Example 1 | 234 g | 231 g | 228 g | 221 g | Good |

TABLE 1-continued

| | Printing speed | | | | Evaluation |
|---|---|---|---|---|---|
| | 20 ppm | 40 ppm | 60 ppm | 70 ppm | result |
| Example 2 | 236 g | 233 g | 232 g | 228 g | (Rank3) Good (Rank2) |
| Example 3 | 238 g | 236 g | 235 g | 234 g | Very good (Rank1) |

FIG. 14 is a graph showing a result of measuring an amount of a developing amount in a developing chamber after printing 1000 sheets by varying a printing speed according to an example.

Referring to FIG. 14, 240 g of a developer was put in the developing chamber 210. The developing device 10 was operated for 90 minutes according to printing speeds, and then an amount of the developer in the developing chamber 210 was measured. In FIG. 14, a comparative example denotes a structure in which the separating member 271 and the air blocking member 274 or 275 are not applied, Example 1 denotes a structure in which the separating member 271 is included (FIG. 4, FIG. 5), Example 2 denotes a structure in which the separating member 271 and the air blocking member 275 are included (FIG. 12), and Example 3 denotes a structure in which the cross-section of the air discharge path 211*b* of Example 1 is doubled. In Example 3, the size of the air outlet 261 is twice the size of that of Example 1.

Referring to FIG. 14, in the comparative example, as the printing speed increases, an amount of the developer in the developing chamber 210 is abruptly reduced. This is because the increase in the air pressure in the developing chamber 210 also increases a discharging speed of the developer and the amount of the developer discharged through the developer discharge outlet 260. In Examples 1, 2, and 3, even when the printing speed increases, the amount of the developer in the developing chamber 210 is gradually decreased as compared to the comparative example. In Example 1, as the air discharge path 211*b* and the developer discharge path 211*a* are separated, the amount of the developer in the developing chamber 210 is maintained relatively stable. In Example 2, the amount of the developer in the developing chamber 210 is more stably maintained by adding the air blocking member 275. In Example 3, by providing large cross-sections of the air discharge path 211*b* and the air outlet 261, the amount of the developer in the developing chamber 210 is more stably maintained.

It should be understood that examples described herein should be considered in a descriptive sense only and not for purposes of limitation. Descriptions of features or aspects within each example should typically be considered as available for other similar features or aspects in other examples.

While one or more examples have been described with reference to the figures, it will be understood by those of ordinary skill in the art that various changes in form and details may be made therein without departing from the spirit and scope as defined by the following claims.

The invention claimed is:

1. A developing device comprising:

a developer transport path to transport a developer;

a developing roller mounted in the developer transport path;

a discharging unit extending from the developer transport path in a length direction of the developing roller, the discharging unit comprising an air outlet to discharge air and a developer discharge outlet to discharge the developer; and a separating member mounted in the discharging unit and configured to separate an inner portion of the discharging unit into an air discharge path connecting the developer transport path and the air outlet, and a developer discharge path connecting the developer transport path and the developer discharge outlet, wherein the separating member comprises a hole to pass a portion of the developer that has flowed into the air discharge path to the developer discharge path.

2. The developing device of claim 1, wherein the air discharge path is located above the developer discharge path with respect to a gravitational direction.

3. The developing device of claim 1, wherein the separating member comprises a plurality of holes to pass the portion of the developer that has flowed into the air discharge path to the developer discharge path.

4. The developing device of claim 1, comprising a developer blocking member in the air discharge path to prevent discharge of the developer through the air outlet.

5. The developing device of claim 4, wherein the developer blocking member comprises an elastic film that elastically blocks the air discharge path.

6. The developing device of claim 4, wherein the developer blocking member comprises a porous material.

7. The developing device of claim 1, wherein the developer transport path comprises a developing chamber extending in the length direction of the developing roller and including the developing roller, an agitating chamber disposed in parallel to the developing chamber, and a barrier wall dividing the developing chamber and the agitating chamber and comprising at both ends of the barrier wall first and second flue holes that communicatively connect the developing chamber and the agitating chamber, wherein the discharging unit extends from the developing chamber.

8. The developing device of claim 1, further comprising an air blocking member configured to partially block the air flowing from the developer transport path into the developer discharge path.

9. The developing device of claim 8, wherein the air blocking member blocks an upper area of the developer discharge path with respect to a gravitational direction.

10. The developing device of claim 8, wherein the air blocking member comprises a blocking portion partially blocking the developer discharge path and a through portion allowing an air flow through the air discharge path.

11. The developing device of claim 1, wherein the separating member is curved.

12. The developing device of claim 8, wherein the developer transport path comprises a developing chamber extending in the length direction of the developing roller and including the developing roller, an agitating chamber disposed in parallel to the developing chamber, and a barrier wall dividing the developing chamber and the agitating chamber and comprising at both ends of the barrier wall first and second flue holes that communicatively connect the developing chamber and the agitating chamber, wherein the discharging unit extends from the developing chamber, the developing device further comprising:

an agitating member mounted in the developing chamber and extending to the discharging unit to transport the developer to the developer discharge outlet, the agitating member comprising a rotational axis and a spiral wing, wherein a spiral wing omitted portion from which the spiral wing is omitted is formed at a location of the rotational axis corresponding the air blocking member.

13. An electrophotographic image forming apparatus comprising:

the developing device of claim 1, configured to form a visible toner image by supplying the developer to an electrostatic latent image formed on a photosensitive body;

a transfer device configured to transfer the toner image to a recording medium; and a fixing device configured to fix the toner image on the recording medium.

14. The developing device of claim 1, further comprising:

an agitating member in the developer transport path and extending into the discharging unit, wherein the agitating member comprises:

a first spiral wing that when rotated in a first rotational direction about a rotational axis of the agitating member directs the developer towards the discharging unit, and a second spiral wing located inside the discharging unit, the second spiral wing when rotated in the first rotational direction about the rotational axis of the agitating member creates a developer flow opposing a direction of flow of the developer caused by the first spiral wing.

15. A developing device comprising:

a developer transport path;

a developing roller mounted in the developer transport path;

a discharging unit extending from the developer transport path in a length direction of the developing roller, the discharging unit comprising an air outlet to discharge air and a developer discharge outlet to discharge the developer;

a separating member mounted in the discharging unit and configured to separate an inner portion of the discharging unit into an air discharge path connecting the developer transport path and the air outlet, and a developer discharge path connecting the developer transport path and the developer discharge outlet;

an agitating member in the developer transport path, the agitating member to transport the developer to the developer discharge outlet, wherein the agitating member extends into an inner portion of the developer discharge path, and wherein the separating member elastically contacts the first agitating member.

16. The developing device of claim 15, wherein the developer transport path comprises a developing chamber extending in the length direction of the developing roller and including the developing roller, an agitating chamber disposed in parallel to the developing chamber, and a barrier wall dividing the developing chamber and the agitating chamber and comprising at both ends of the barrier wall first and second flue holes that communicatively connect the developing chamber and the agitating chamber, wherein the discharging unit extends from the developing chamber.

17. The developing device of claim 16, wherein the agitating member is mounted in the developing chamber.

18. The developing device of claim 17, wherein the agitating member is a first agitating member, the developing device further comprising:

a second agitating member mounted in the agitating chamber.

19. A developing device comprising:

a developer transport path to transport and agitate a developer;

a developing roller mounted in the developer transport path;

a discharging unit extending from the developer transport path in a length direction of the developing roller, the discharging unit comprising a developer discharge outlet to discharge the developer, wherein the discharging unit further comprises a developer discharge path connecting the developer transport path and the developer discharge outlet, the developer to flow from the developer transport path through the developer discharge path to the developer discharge outlet; and an air blocking member partially blocking air from flowing from the developer transport path into the developer discharge path.

20. The developing device of claim 19, wherein the air blocking member is between the developer transport path and the developer discharge path.

21. The developing device of claim 19, wherein the developer transport path comprises a developing chamber extending in the length direction of the developing roller and including the developing roller, an agitating chamber disposed in parallel to the developing chamber, and a barrier wall dividing the developing chamber and the agitating chamber and comprising at both ends of the barrier wall first and second flue holes that communicatively connect the developing chamber and the agitating chamber, wherein the discharging unit extends from the developing chamber, the developing device comprising:

an agitating member mounted in the developing chamber and extending to the discharging unit to transport the developer to the developer discharge outlet the agitating member comprising a rotational axis and a spiral wing.

22. The developing device of claim 19, wherein the discharging unit comprises a separating member to separate an inner portion of the discharging unit into:

an air discharge path connecting the developer transport path and an air outlet of the discharging unit, and the developer discharge path.

* * * * *